US008079816B2

(12) United States Patent
Huang et al.

(10) Patent No.: US 8,079,816 B2
(45) Date of Patent: Dec. 20, 2011

(54) FAN AND IMPELLER THEREOF

(75) Inventors: Ci-Ming Huang, Taoyuan Hsien (TW); Kun-Ming Lee, Taoyuan Hsien (TW); Ya-Hui Hung, Taoyuan Hsien (TW); Ching-Hsiang Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 593 days.

(21) Appl. No.: 12/209,844

(22) Filed: Sep. 12, 2008

(65) Prior Publication Data

US 2009/0246024 A1 Oct. 1, 2009

(30) Foreign Application Priority Data

Mar. 31, 2008 (TW) ..... 97111612 A

(51) Int. Cl.
*F04D 29/36* (2006.01)

(52) U.S. Cl. ..... 416/135; 416/240

(58) Field of Classification Search ..... 415/140, 415/141; 416/131, 134 R, 135, 204 R, 240, 416/136, 132 R, 132 A, 147, 205
See application file for complete search history.

(56) References Cited

U.S. PATENT DOCUMENTS

| | | | | |
|---|---|---|---|---|
| 2,149,267 | A * | 3/1939 | Bouvy et al. | 416/134 R |
| 5,152,606 | A | 10/1992 | Borraccia et al. | |
| 6,715,989 | B2 * | 4/2004 | Mosiewicz et al. | 416/134 R |

FOREIGN PATENT DOCUMENTS

| | | |
|---|---|---|
| CN | 2056465 | 4/1990 |
| DE | 10307887 | 10/2004 |
| TW | 221563 | 3/1994 |
| TW | 200728608 | 8/2007 |

* cited by examiner

*Primary Examiner* — Richard Edgar

(74) *Attorney, Agent, or Firm* — Muncy, Geissler, Olds & Lowe, PLLC

(57) ABSTRACT

A fan includes an impeller and a fan frame. The impeller is accommodated within the fan frame. The impeller has a hub and a plurality of blades disposed around the hub. The hub has a top portion and a side wall connected with the top portion. The hub further has a plurality of flexible portions disposed and located on the side wall. The blades are connected with the flexible portions, respectively, so that the blades are connected to the hub.

20 Claims, 5 Drawing Sheets

FAN AND IMPELLER THEREOF

CROSS REFERENCE TO RELATED APPLICATIONS

This Non-provisional application claims priority under 35 U.S.C. §119(a) on Patent Application No(s). 097111612, filed in Taiwan, Republic of China on Mar. 31, 2008, the entire contents of which are hereby incorporated by reference.

BACKGROUND OF THE INVENTION

1. Field of Invention

The present invention relates to a fan and an impeller thereof, which has a flexible portion for dynamically adjusting the angle of attack (AOA) of the blade so as to decrease areas of the stall region.

2. Related Art

An axial-flow fan can induce airflows by rotating its impeller to form a pressure drop. As shown in FIGS. 1 and 2, the blades 12 are fixed wings disposed around the hub 11. Therefore, the angle of attack "A" between the blades 12 and the airflow W is fixed. When the impeller 10 rotates, the blades 12 can not have any angle change relative to the hub 11.

In the conventional fan, since the angle of attack of the blade is fixed, a certain period of stall appears during the back-pressure experiment in the wind tunnel. In this stall period, the airflow worked by the blade is very unstable, which results in loud noise and poor heat dissipation property of the fan.

SUMMARY OF THE INVENTION

In view of the foregoing, the present invention is to provide an impeller having a plurality of flexible portions for allowing the angle of attack of the blades to be changed according to the load so as to improve the fan property of air pressure and quantity and decrease areas of the stall region.

To achieve the above, the present invention discloses a fan including an impeller and a fan frame. The impeller has a hub and a plurality of blades disposed around the hub. The hub has a plurality of flexible portions. The blades are connected with the flexible portions, respectively, so that the blades are connected to the hub. The impeller is accommodated in the fan frame.

As mentioned above, the fan and impeller of the present invention can dynamically change the angle of attack between the blade and the airflow when the impeller rotates. Therefore, the areas of stall region of the fan can be decreased, so that the performance of the fan can be improved.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

A fan and an impeller thereof according to an embodiment of the present invention, which can decrease areas of the stall region and improve the fan property of air pressure and quantity, will be described herein below.

Figure 1:
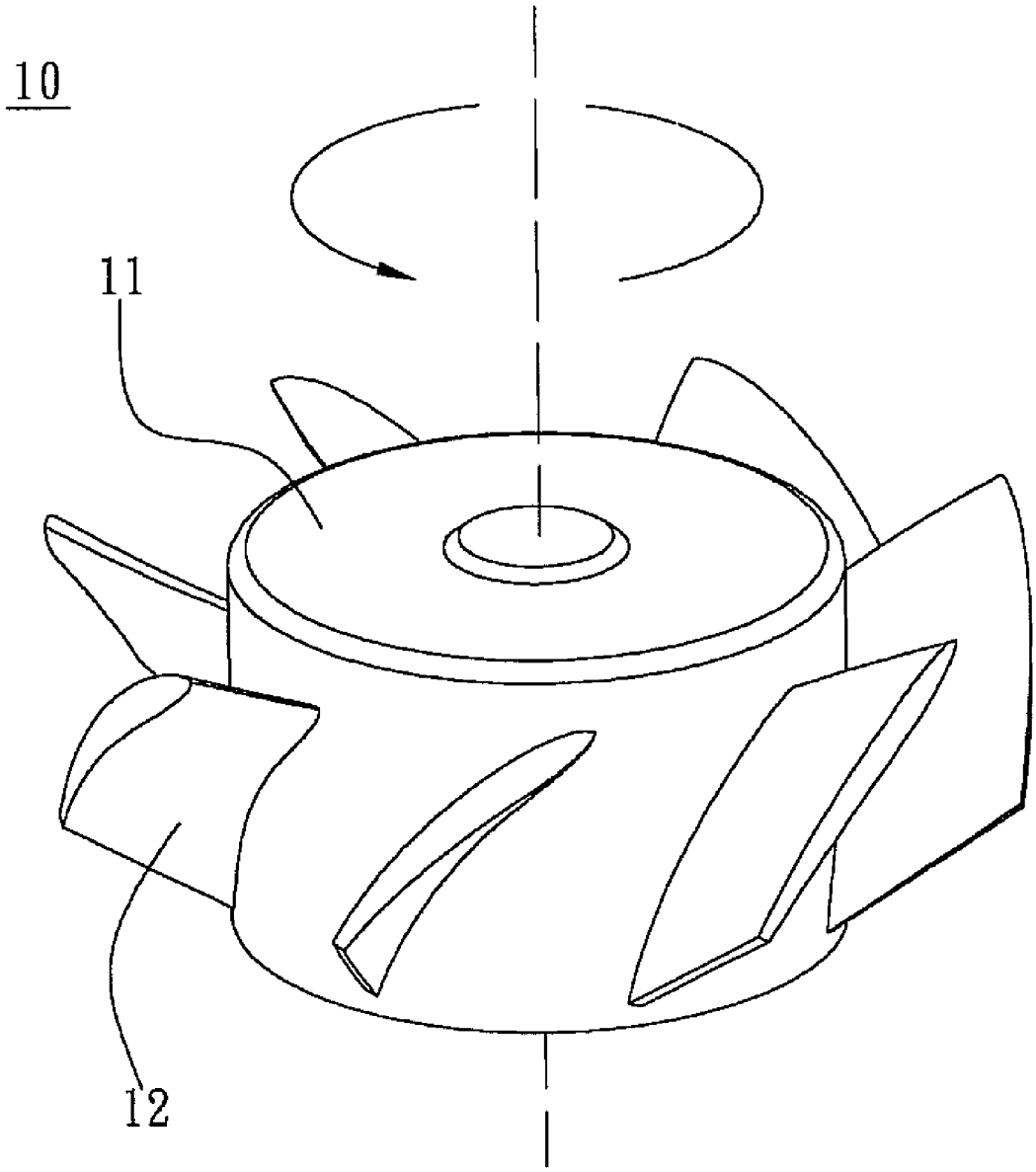
FIG. 1(PRIOR ART)
FIG. 1 is a three-dimensional view of a conventional fan impeller.
Figure 2:
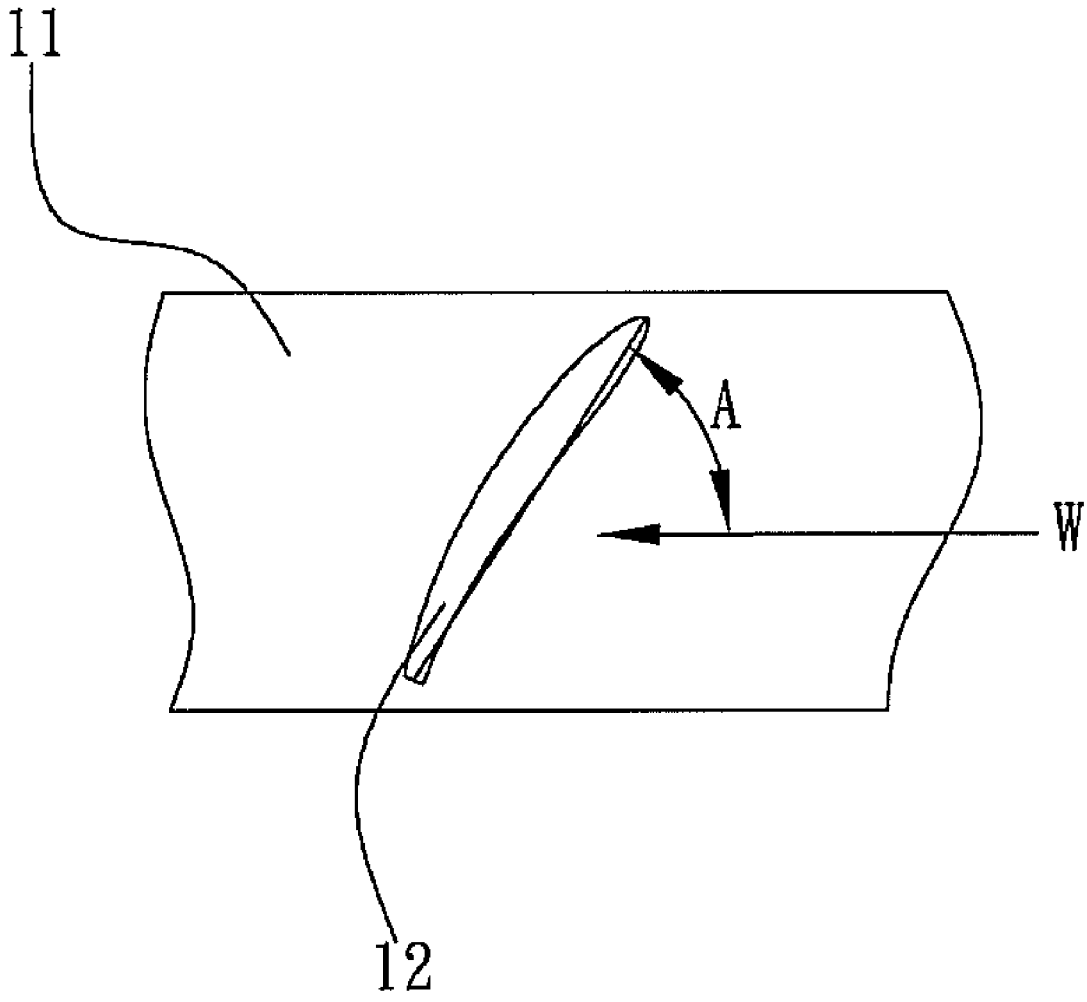
FIG. 2(PRIOR ART)
FIG. 2 is a partial side view of the conventional fan impeller in FIG. 1.
Figure 3:
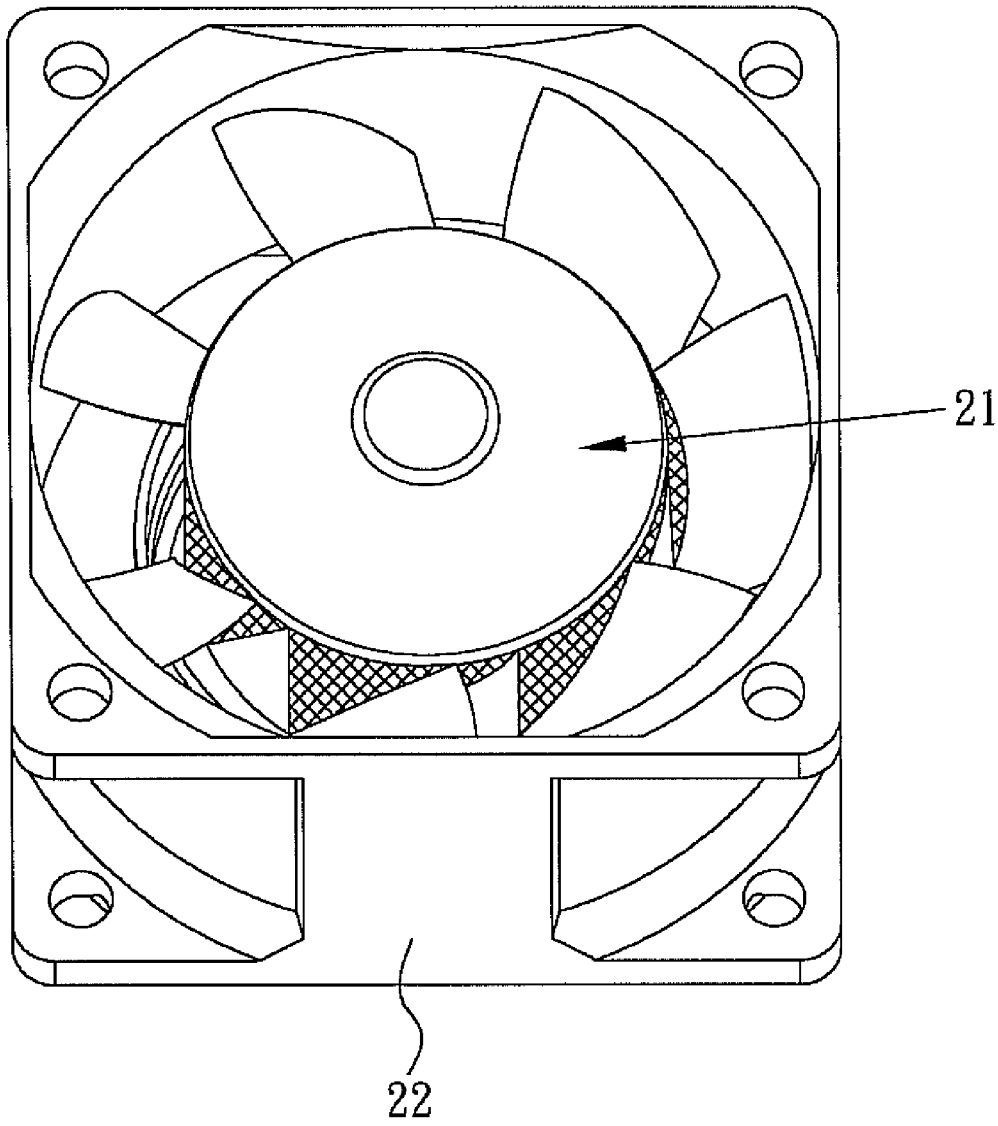
FIG. 3 is a three-dimensional view of a fan and an impeller thereof according to the preferred embodiment of the present invention.
Figure 4:
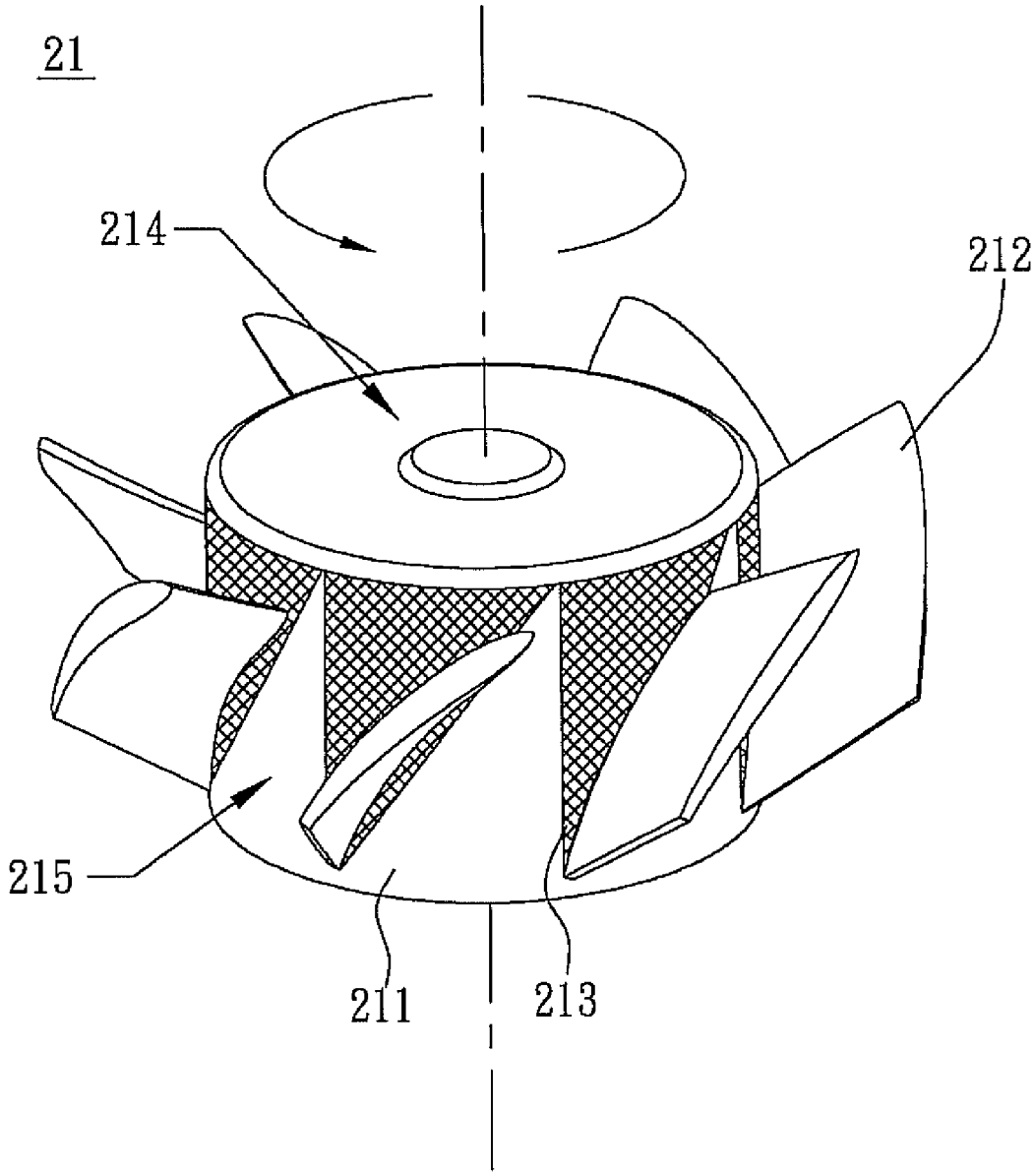
FIG. 4 is a three-dimensional view of the impeller in FIG. 3.
Figure 5:
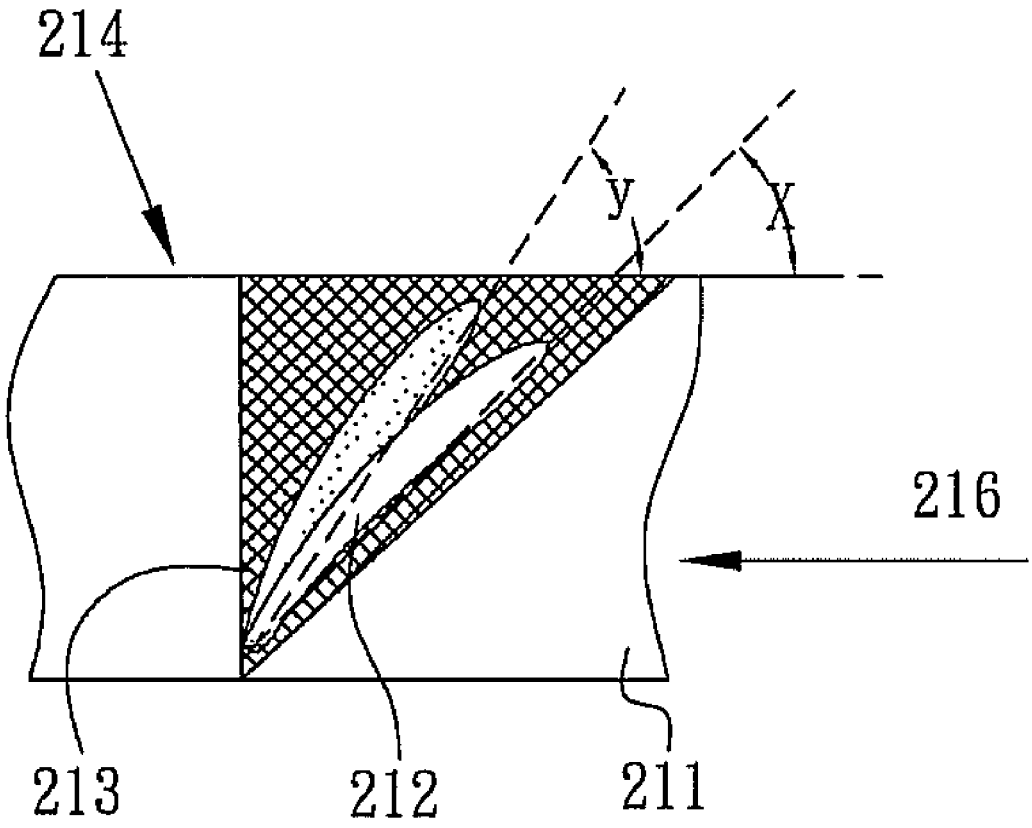
FIG. 5 is a partial side view of the impeller in FIG. 4.

With reference to FIGS. 3, 4 and 5, a fan 20 according to the preferred embodiment of the present invention includes an impeller 21 and a fan frame 22 accommodating the impeller 21. The impeller 21 includes a hub 211 and a plurality of blades 212 disposed around the hub 211. Several flexible portions 213 are disposed and located on the side wall of the hub 211. The blades 212 are disposed corresponding to the flexible portions 213, respectively, so that the blades 212 can be disposed on the hub 211. The hub 211 includes a top portion 214 and a side wall 215 connected with each other. The material of the flexible portions 213 can include a silica gel or rubber. Each flexible portion 213 is extended downwardly from the edge of the top portion 214 and decreased gradually along the side wall 215, so that the flexible portion 213 can be disposed on the side wall 215 of the hub 211 relative to the corresponding blade 212.

The flexible portions 213 can be made of a flexible material such as a silica gel or rubber. The residual portion of the hub 211 other than the flexible portions 213 can be made of a relative rigid material compared to the materials of flexible portions 213, such as a plastic material or metal. During the process of manufacturing the impeller 21, the flexible portions 213 are formed in advance and then disposed in a predetermined location where the hub 211 will be formed so that when the hub 211 and blades 212 are formed by molding and injecting, the flexible portions 213 are disposed and located on the side wall of the hub 211, and the blades are connected and disposed around the hub 211 via connecting with the flexible portions 213. However, the present invention is not limited thereto, and the impeller 21 can be manufactured by another way. For example, the top portion 214 and the side wall 215 of the hub 211 are formed in advance, and then the flexible material is applied to a position where the flexible portion 213 will be formed by pouring and casting, injecting, or close fitting, and further the blades 212 are formed to connected and disposed around the hub 211 via connecting with the flexible portions 213. Therefore, the side wall 215 of the hub 211 is made of at least two different materials, i.e. a flexible material and relative rigid material.

As shown in FIG. 5, when the impeller 21 stops rotating, the blades 212 and the top portion 214 form a first included angle "x". Then, when the impeller 21 rotates, the airflow 216 can be induced to work on the blades 212, so that the blades 212 and the top portion 214 of the hub 211 form a second included angle "y". In the embodiment, the first included angle "x" and the second included angle "y" are different, and the difference therebetween roughly ranges from 0 to 20 degrees.

In summary, the fan and impeller of the present invention have above-mentioned flexible portion, so that the angle of attack between the blade and the airflow can be dynamically changed when the impeller rotates. Therefore, areas of the stall region of the fan can be decreased, so that the performance of the fan can be improved and the noise can be reduced.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An impeller, comprising:

a hub having a plurality of flexible portions; and a plurality of blades disposed around the hub, wherein the blades are connected with the flexible portions, respectively;

wherein the hub has a top portion and a side wall connected with the top portion, and the flexible portions are disposed and located on the side wall and each of the flexible portions is extended downwardly from the edge of the top portion and decreased gradually along the side wall.

2. The impeller according to claim 1, wherein each of the flexible portions is extended downwardly from the edge of the top portion and disposed on the side wall of the hub relative to the corresponding blade.

3. The impeller according to claim 1, wherein the flexible portions are formed in advance and then disposed in a predetermined location where the hub will be formed so that when the hub and blades are formed by molding and injecting, the flexible portions are disposed and located on the side wall of the hub, and the blades are connected and disposed around the hub via connecting with the flexible portions during the process of manufacturing the impeller.

4. The impeller according to claim 1, wherein the top portion and the side wall of the hub are formed in advance, and then a flexible material is applied to a position where the flexible portion will be formed by pouring and casting, injecting, or close fitting, and further the blades are formed to connected and disposed around the hub via connecting with the flexible portions.

5. The impeller according to claim 1, wherein a material of the flexible portions comprises a flexible material.

6. The impeller according to claim 1, wherein when the impeller stops, the blades and the top portion form a first included angle; when the impeller rotates, the blades and the top portion form a second included angle, and the first included angle and the second included angle are different.

7. The impeller according to claim 6, wherein the difference between the first included angle and the second included angle roughly ranges from 0 to 20 degrees.

8. The impeller according to claim 1, wherein a residual portion of the hub other than the flexible portions comprises a relative rigid material.

9. The impeller according to claim 1, wherein the flexible material is silica gel or a rubber.

10. The impeller according to claim 1, wherein the relative rigid material is a plastic material or metal.

11. A fan, comprising:

an impeller comprising a hub and a plurality of blades disposed around the hub, wherein the hub has a plurality of flexible portions, and the blades are disposed on the hub corresponding to the flexible portions, respectively; and a fan frame accommodating the impeller;

wherein the hub has a top portion and a side wall connected with the top portion, and the flexible portions are disposed and located on the side wall and each of the flexible portions is extended downwardly from the edge of the top portion and decreased gradually along the side wall.

12. The fan according to claim 11, wherein each of the flexible portions is extended downwardly from the edge of the top portion and disposed on the side wall of the hub along the corresponding blade.

13. The fan according to claim 11, wherein the flexible portions are formed in advance and then disposed in a predetermined location where the hub will be formed so that when the hub and blades are formed by molding and injecting, the flexible portions are disposed and located on the side wall of the hub, and the blades are connected and disposed around the hub via connecting with the flexible portions during the process of manufacturing the impeller.

14. The fan according to claim 11, wherein the top portion and the side wall of the hub are formed in advance, and then a flexible material is applied to a position where the flexible portion will be formed by pouring and casting, injecting, or close fitting, and further the blades are formed to connected and disposed around the hub via connecting with the flexible portions.

15. The fan according to claim 11, wherein a material of the flexible portions comprises a flexible material.

16. The fan according to claim 11, wherein when the impeller stops, the blades and the top portion form a first included angle; when the impeller rotates, the blades and the top portion form a second included angle, and the first included angle and the second included angle are different.

17. The fan according to claim 16, wherein the difference between the first included angle and the second included angle roughly ranges from 0 to 20 degrees.

18. The fan according to claim 11, wherein a residual portion of the hub other than the flexible portions comprises a relative rigid material.

19. The fan according to claim 11, wherein the flexible material is silica gel or a rubber.

20. The fan according to claim 11, wherein the relative rigid material is a plastic material or metal.

* * * * *